US006039118A

United States Patent [19]

Carter et al.

[11] Patent Number: 6,039,118

[45] Date of Patent: Mar. 21, 2000

[54] WELLBORE TOOL MOVEMENT CONTROL AND METHOD OF CONTROLLING A WELLBORE TOOL

[75] Inventors: Thurman B. Carter; Michael A. Luke, both of Houston; John D. Roberts, Spring, all of Tex.

[73] Assignee: Weatherford/Lamb, Inc., Houston, Tex.

[21] Appl. No.: 08/846,456

[22] Filed: May 1, 1997

[51] Int. Cl.[7] ..... B21B 17/07; B21B 19/09

[52] U.S. Cl. ..... 166/355; 175/321

[58] Field of Search ..... 175/321, 7; 166/355, 166/363, 381

[56] References Cited

U.S. PATENT DOCUMENTS

| | | | |
|---|---|---|---|
| 1,498,691 | 6/1924 | Kearns . | |
| 1,619,728 | 3/1927 | Hopkins . | |
| 1,660,033 | 2/1928 | Barswell . | |
| 1,669,898 | 5/1928 | Chase | 166/211 |
| 1,686,945 | 10/1928 | Abercrombie . | |
| 1,785,559 | 12/1930 | Ponti . | |
| 2,054,255 | 9/1936 | Howard | 175/298 |
| 2,102,236 | 12/1937 | Johansen . | |
| 2,210,506 | 8/1940 | Smith | 464/163 |
| 2,240,519 | 5/1941 | Reed | 175/321 |
| 2,684,835 | 7/1954 | Moore | 175/321 |
| 2,712,435 | 7/1955 | Allen . | |
| 2,815,928 | 12/1957 | Bodine, Jr. | 175/56 |
| 2,835,474 | 5/1958 | O'Connor et al. | 175/299 |
| 2,929,610 | 3/1960 | Stratton | 166/354 |
| 2,937,007 | 5/1960 | Whittle | 175/94 |
| 2,991,635 | 7/1961 | Warren | 464/21 |
| 3,033,011 | 5/1962 | Garrett . | |
| 3,037,803 | 6/1962 | Phillips . | |
| 3,073,134 | 1/1963 | Mann . | |
| 3,099,918 | 8/1963 | Garrett . | |
| 3,100,538 | 8/1963 | Sanders | 166/237 |
| 3,122,902 | 3/1964 | Blair et al. | 464/21 |
| 3,156,106 | 11/1964 | Crane | 464/20 |
| 3,194,330 | 7/1965 | Ware et al. | 175/321 |
| 3,248,886 | 5/1966 | Blenkarn . | |
| 3,274,798 | 9/1966 | Wiggins, Jr | 464/20 |
| 3,301,324 | 1/1967 | Smith | 166/355 |
| 3,314,657 | 4/1967 | Prudhomme et al. . | |
| 3,323,327 | 6/1967 | Leathers et al. | 464/20 |
| 3,354,950 | 11/1967 | Hyde | 175/321 X |
| 3,378,072 | 4/1968 | Smith . | |
| 3,382,936 | 5/1968 | Galle . | |
| 3,513,911 | 5/1970 | Petersen . | |
| 3,516,703 | 6/1970 | Templeton . | |
| 3,570,598 | 3/1971 | Johnson . | |
| 3,606,297 | 9/1971 | Webb | 267/125 |
| 3,667,252 | 6/1972 | Nelson . | |
| 3,721,293 | 3/1973 | Ahlstone et al. . | |
| 3,746,329 | 7/1973 | Galle . | |
| 3,830,306 | 8/1974 | Brown . | |
| 3,835,924 | 9/1974 | Albers et al. . | |
| 3,917,006 | 11/1975 | Kellner . | |
| 3,941,190 | 3/1976 | Conover | 166/187 |
| 3,965,980 | 6/1976 | Williamson . | |
| 3,973,468 | 8/1976 | Russell, Jr. | 91/25 |
| 3,991,837 | 11/1976 | Crickmer . | |
| 4,055,338 | 10/1977 | Dyer . | |
| 4,067,405 | 1/1978 | Bassinger | 175/321 |
| 4,072,190 | 2/1978 | Raulins | 175/321 X |
| 4,139,994 | 2/1979 | Alther . | |
| 4,268,013 | 5/1981 | Khan | 254/392 |
| 4,273,372 | 6/1981 | Sheshtawy | 294/86.15 |
| 4,438,910 | 3/1984 | McFadden | 267/126 |
| 4,466,487 | 8/1984 | Taylor, Jr. | 166/339 |
| 4,535,972 | 8/1985 | Millheim et al. | 254/277 |
| 4,540,159 | 9/1985 | Jordan | 254/228 |
| 4,664,205 | 5/1987 | Knighton et al. | 175/58 |
| 4,693,316 | 9/1987 | Riggenberg et al. | 166/355 |
| 4,784,540 | 11/1988 | Underhaug | 409/140 |
| 5,103,906 | 4/1992 | Schultz et al. | 166/264 |
| 5,224,558 | 7/1993 | Lee | 175/325.4 |
| 5,348,351 | 9/1994 | LaFleur et al. | 285/110 |
| 5,350,015 | 9/1994 | Hailey | 166/55.8 |
| 5,664,629 | 9/1997 | Maitland | 166/373 |
| 5,697,768 | 12/1997 | Mills | 417/365 |
| 5,806,611 | 9/1998 | VanDenSteen et al. | 175/27 |

FOREIGN PATENT DOCUMENTS

| | | |
|---|---|---|
| 85 304072 | 10/1985 | European Pat. Off. . |
| 1 169407 | 3/1957 | France . |
| 842190 | 12/1957 | United Kingdom . |
| 1 109769 | 11/1966 | United Kingdom . |
| PCT/GB80/ 00196 | 11/1980 | WIPO . |

OTHER PUBLICATIONS

OG Aug 19,1997 entry for US Patent 5,657,823.
OG Jan. 7, 1997 entry for US Patent 5,590,714.
Completion Solutions From TIW, 1990–91 Gen Catalog.
Single Joint Pick Up Cylinder, Frank's Int'l 1993.
General Catalog 1974–1975, A–2 International, pp. 178, 179, 1974.
PCT Int'l Search Report, PCT/GB98/01127, counterpart of this case.
OG Jul. 14, 1998 entry for US Patent 5,778,981.

*Primary Examiner*—David J. Bagnell
*Attorney, Agent, or Firm*—Guy McClung

[57] ABSTRACT

A wellbore motion control apparatus for controlling the motion of a tubular wellbore string in a wellbore extending from a surface down into the earth and methods for using it. Such an apparatus, in one aspect, has a housing with a top end, a bottom end, and a hollow interior having an interior volume with fluid therein. There is at least one fluid passage apparatus having a top end and a bottom end and disposable in the hollow interior of the housing, the at least one fluid passage apparatus having a fluid flow channel extending therethrough from the top end to the bottom end. The at least one fluid passage apparatus is securable to a member of the tubular wellbore string while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing controlling movement of the member of the tubular wellbore string and thereby controlling movement of the tubular string in the wellbore.

30 Claims, 9 Drawing Sheets

22
44
84
80
98
97
96
95
90
99
106
9
9
139
184
182
196
193
197
198
183
195
188
104
192
104a
104
104b
181
169
189
100

WELLBORE TOOL MOVEMENT CONTROL AND METHOD OF CONTROLLING A WELLBORE TOOL

BACKGROUND OF THE INVENTION

1. Field Of The Invention

This invention is directed to motion controllers and compensators for items used in wellbores; to such devices useful with downhole drilling and/or milling tools and to downhole milling assemblies with such a device; to such devices useful with tools in a wellbore extending down from the sea floor and tools with such a device; and methods of using such items.

2. Description of Related Art

In milling a tubular with a downhole mill, using too much weight on the mill and/or advancing the mill too quickly can result in inadequate milling, inefficient milling, and damage to the milling system and to the item to be milled.

When milling in an environment in which contact between a milling system and a tubular to be milled is interrupted and then the milling system is again thrust against the tubular to be milled, it is possible to severely damage the milling system with an abrupt intense impact against the tubular being milled. In offshore milling operations, a mill lifted away from a tubular being milled, e.g. by a swell at the water's surface that lifts a boat or barge from which the milling system is suspended, can be slammed back into the tubular being milled as the swell passes and the boat is effectively lowered.

There has long been a need for apparatus to effectively control the rate at which an item is lowered in a wellbore. There has long been a need for an apparatus to compensate for unwanted motion that raises a tool in a wellbore when the tool is intended to be advanced in a direction opposite to that of the unwanted motion. There has long been a need, recognized now by the present inventors, to control the rate of advance of a downhole mill in certain milling operations. There has long been a need, recognized now by the present inventors, to advance, in a controlled manner, a downhole mill that is intermittently lifted away from an item that is being milled.

SUMMARY OF THE PRESENT INVENTION

The present invention, in certain aspects, discloses a system for controlling the rate of lowering of an item in a wellbore; such a system in one aspect including a central tubular member or string to be lowered in a wellbore; at least one sleeve around the central tubular member and spaced apart therefrom; an exterior of the central tubular member and an interior of the sleeve defining an enclosed volume therebetween contained a fluid; the central tubular member having affixed thereto and projecting therefrom into the enclosed volume a flow control member with a fluid passageway therethrough, the fluid passageway sized for the controlled passage therethrough of fluid in the enclosed volume from one side of the flow control member to the other so that the central tubular member's movement is limited by and thereby controlled by the rate of movement of the flow control member within the enclosed volume; and the flow control member movably and sealingly mounted for up and down movement in the enclosed volume.

In another aspect, such a system as discussed above has two enclosed volumes and at least two flow control assemblies, each with at least one flow control member in each enclosed volume. One flow control assembly controls an initial tool descent and the other controls a subsequent descent associated with an interruption between contact of the tool with a desired item. In one aspect the first flow control assembly provides for a controlled descent for initial tool/item contact and, in certain embodiments, takes tens of minutes or even hours to effect desired descent and contact. In one aspect, the second flow control assembly effects re-contact of a tool and the item relatively quickly, e.g. in seconds or in about a minute or minutes.

In another aspect, an expansion/contraction compensator is provided for each enclosed volume (one or more enclosed volumes) which includes a movable piston movably disposed in a chamber having a compressible fluid on one side of the piston while the other side is in fluid communication with the fluid in the enclosed volume. Pressure on the sleeve's exterior (e.g. by the hydrostatic head of fluid in a wellbore) pushes fluid from the enclosed volume into the chamber, moving the piston. The piston compresses the gas on the side opposite the moving fluid, allowing fluid excess to enter the chamber to accommodate the decrease in volume effected by the pressure on the sleeve. Upon the cessation of the pressure on the sleeve, the compressed fluid pushes on the piston, pushing the fluid from the chamber back into the enclosed volume.

In one aspect the system includes a tubular string of drill pipe and drill collars extending from a rig, and including a drill bit or a mill or mills attached at the bottom of the string for milling a tubular, e.g. a liner or casing, by rotation of the string, either from the surface or by a downhole motor. In one such system a sleeve assembly rests in and on a wellhead either at the earth's surface or on the sea floor. The sleeve assembly is stationary with respect to the wellhead while the central tubular member, attached in the tubular string is rotatable. To facilitate rotation, the sleeve assembly has a bottom that rolls and rotates on a lower bearing assembly and in a side bearing assembly.

In one aspect, roller bearings of the lower bearing assembly produce heat that expands lubricating fluid therearound. To compensate for this expansion, a chamber in fluid communication with the lubricating fluid has a free floating piston movably disposed therein with a compressible fluid on a piston side opposite to the side in contact with the lubricating fluid. As the lubricating fluid expands, the piston moves in the chamber, compressing the compressible fluid. As the lubricating fluid cools, the compressed compressible fluid moves the piston back to its initial position.

Systems according to the present invention may be used to control the movement of a mill(s), a drill bit, or a mill-drill tool, e.g. as disclosed in the pending U.S. application entitled "Wellbore Milling-Drilling" filed on Apr. 2, 1997, U.S. Ser. No. 08/832,483 and co-owned with the present invention, which application is incorporated fully herein for all purposes.

In one aspect, such a system has a first flow control assembly that initially lowers a mill to contact and mill a tubular to be milled at a controlled rate of advance and a second flow control assembly that re-lowers the mill to contact the tubular in the event the mill is inadvertently lifted away from the tubular. In one aspect the first control assembly takes about a half, one, two, five, ten or more hours to lower the mill and the second flow control assembly re-lowers the mill in about one, two, three, four, five, ten or more minutes.

In one system such as any system discussed above, one or both (or more if there are three, four or more) flow control assemblies has check valves therein which prevent fluid from flowing back through the flow control assembly. For example, in a system in which a first upper flow control assembly moves down about five feet in an enclosed volume and then the entire tubular string is raised, a check valve in the first upper flow control assembly that previously has allowed fluid to pass from a bottom side of the flow control assembly, through the flow control assembly, to a top side of the flow control assembly, now prevents fluid passage in the opposite direction (top to bottom). Thus the flow control assembly will not move back up in the enclosed volume and holds the central tubular member at the same location with respect to the sleeve until downward movement (fluid flow from bottom to top) of the flow control assembly again commences.

In one aspect the system is positioned in and as part of a tubular wellbore string, in one aspect a part between a boat and a wellhead at the seabed surface. In another aspect, the system—with either a solid central mandrel or a hollow one—is used in the cable system that supports the string.

In one aspect the enclosed volume is fillable with fluid at the surface; and/or re-fillable with fluid. In one aspect the sleeve(s) rotate with the central tubular member.

In certain embodiments, the present invention discloses a wellbore motion control apparatus for controlling the motion of a tubular wellbore string in a wellbore extending from a surface down into the earth, the motion control apparatus having a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus securable to a member of the tubular wellbore string while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing controlling movement of the member of the tubular wellbore string and thereby controlling movement of the tubular string in the wellbore; such an apparatus wherein the member of the tubular string is a mandrel with a top end and a bottom end, each end connectible to another member of the tubular string; such an apparatus wherein the mandrel has a fluid flow bore therethrough from the top end thereof to the bottom end thereof; such an apparatus wherein the bottom end of the housing has a bevelled edge for seating against a corresponding edge of a part of a wellhead; such an apparatus wherein the at least one fluid passage apparatus is at least two fluid passage apparatuses; such an apparatus wherein the fluid in the housing is liquid; such an apparatus wherein the fluid in the housing is gas; such an apparatus wherein the fluid flow channel is sized so that the fluid passage apparatus traverses the housing from one end thereof to the other end thereof in about an hour; such an apparatus wherein the fluid flow channel is sized so that the fluid passage apparatus traverses the housing from one end thereof to the other end thereof in about a minute; any such apparatus with a mandrel wherein the at least one fluid passage apparatus is secured to the mandrel; such a apparatus wherein the tubular wellbore string has a lower end and cutting apparatus attached at the lower end; such an apparatus including the cutting apparatus; such an apparatus wherein the cutting apparatus comprises tubular milling apparatus, drilling apparatus, mill-drill apparatus, or any combination thereof; any such apparatus with check valve apparatus in the fluid flow channel of the at least one fluid passage apparatus for permitting flow through the fluid flow channel from the bottom of the at least one fluid passage apparatus to the top thereof and out therefrom into space above the at least one fluid passage apparatus in the hollow interior of the housing, the check valve apparatus preventing fluid flow in the opposite direction from the space above the at least one fluid passage apparatus to a space below it in the hollow interior of the housing; any such apparatus with a bearing apparatus secured to the member of the tubular wellbore string, and the wellbore motion control apparatus having a bottom end resting on and rotatable on the bearing apparatus; any such apparatus wherein the bearing apparatus has a plurality of rollers rotatably mounted in a primary chamber therein, the primary chamber contains lubricant for lubricating the rollers, an expansion chamber is in fluid communication with the primary chamber, and a piston is movably disposed in the expansion chamber and biased downwardly by a spring in the expansion chamber above the piston, the piston movable upwardly in response to lubricant expanded by heating from the primary chamber; any such apparatus with an amount of compressible gas above the piston in the expansion chamber which gas is compressed as the piston moves up; any such apparatus with the housing having a selectively openable top port and a selectively openable bottom port for accessing the hollow interior of the housing to remove therefrom and to introduce thereinto fluid; any such apparatus with a housing chamber having a top and a bottom, and the housing's hollow interior in fluid communication with the housing chamber, a piston movably disposed in the housing chamber with an amount of gas above the piston in the housing chamber, the piston positioned for contact by the fluid in the housing's hollow interior so that compression of the housing by pressure of fluid external thereto moves the fluid in the hollow interior against the piston forcing it upwardly in the housing chamber and compressing the gas above the piston.

The present invention discloses, in certain aspects, a wellbore motion control apparatus for controlling the motion of a tubular wellbore string in a wellbore extending from a surface down into the earth, the motion control apparatus having as a first apparatus any apparatus for motion control described herein, and as a second apparatus any motion control apparatus described herein; any such apparatus wherein a fluid flow rate in the first apparatus is less than a flow rate in the second apparatus; any such apparatus wherein the first flow rate is such that the at least one first fluid passage apparatus in the first apparatus traverses a housing of the first apparatus from one end to the other end thereof in about an hour and wherein the flow rate for the second apparatus is such that a fluid passage apparatus in the second apparatus traverses a housing thereof from one end thereof to the other in about a minute; such an apparatus wherein check valve apparatus in the first fluid flow channel of the at least one first fluid passage apparatus for permitting flow through the first fluid flow channel from the bottom of the at least one first fluid passage apparatus to the top thereof and out therefrom into space above the at least one first fluid passage apparatus in the hollow interior of the first housing, the check valve apparatus preventing fluid flow in the opposite direction from the space above the at least one first fluid passage apparatus to a space below it in the hollow interior of the first housing.

The present invention discloses, in certain aspects a wellbore motion control apparatus for controlling the motion of a tubular wellbore string in a wellbore extending from a surface down into the earth, the motion control having a housing with a top end, a bottom end, and a hollow interior having an interior volume with fluid therein, a mandrel having a top end and a bottom end, the mandrel mounted for movement in the housing, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the mandrel while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing thereby controlling movement of the mandrel; any such apparatus wherein the mandrel is solid.

The present invention discloses, in certain aspects a method for controlling the motion of a tubular string used in wellbore operations, the method including connecting a wellbore motion control apparatus in the tubular string, the wellbore motion control apparatus having a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus securable to a member of the tubular wellbore string while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing controlling movement of the member of the tubular wellbore string and thereby controlling movement of the tubular string in the wellbore; and flowing the fluid in the hollow interior of the housing from a space below the at least one fluid passage apparatus, through the at least one fluid passage apparatus, to a space above the at least one fluid passage apparatus as the at least one fluid passage apparatus moves down in the housing thereby controllably moving the tubular string down.

The present invention discloses, in certain aspects, a method for controlling the motion of an item (e.g. but not limited to a tubular, a tubular string, or any wellbore tool or device) used in wellbore operations, the method including connecting a wellbore motion control apparatus between the item and a rig support (e.g. but not limited between a support cable and the item or as a member of a tubular string; e.g. as a joint compensator) for the item, the wellbore motion control apparatus having a housing with a top end, a bottom end, and a hollow interior having an interior volume with fluid therein, a mandrel having a top end and a bottom end, the mandrel mounted for movement in the housing, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the mandrel while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing thereby controlling movement of the mandrel, and flowing the fluid in the hollow interior of the housing from a space below the at least one fluid passage apparatus, through the at least one fluid passage apparatus, to a space above the at least one fluid passage apparatus as the at least one fluid passage apparatus moves down in the housing thereby controllably moving the item down. In one such method control apparatus may be provided for opening and closing fluid flow channel(s) in the fluid passage apparatus to control the movement of the at least one fluid passage apparatus thereby controlling movement of the item. Such control apparatus may be operable on the rig floor, adjacent the item, and/or remote therefrom. In one aspect the control apparatus opens and closes the fluid flow channel(s). In another aspect, the control apparatus controls the cross-sectional size of the fluid flow channel.

It is, therefore, an object of at least certain preferred embodiments of the present invention to provide:

New, useful, unique, efficient, nonobvious apparatuses and methods for controlling the motion up and down of an item in a wellbore;

Such apparatuses and methods for controlling the descent of an item in a wellbore and, in one aspect, in a wellbore extending down from the seabed, and for known incremental distance advance;

Such apparatuses and methods for controlling the advance of an apparatus or device in a wellbore, including but not limited to the advance of a drill bit as it drills formation or of a mill system as it mills a tubular; and such apparatus useful in a cable system in a rig that supports a tubular wellbore string or within the string itself;

Such apparatus and methods for controllingly re-lowering a bit or mill when its contact with formation or a tubular is interrupted;

Such apparatus or methods including expansion/contraction compensation apparatus; and Such apparatus and methods for compensating for expanding lubrication fluid used in lubricating one or more bearings used in such apparatus and methods.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
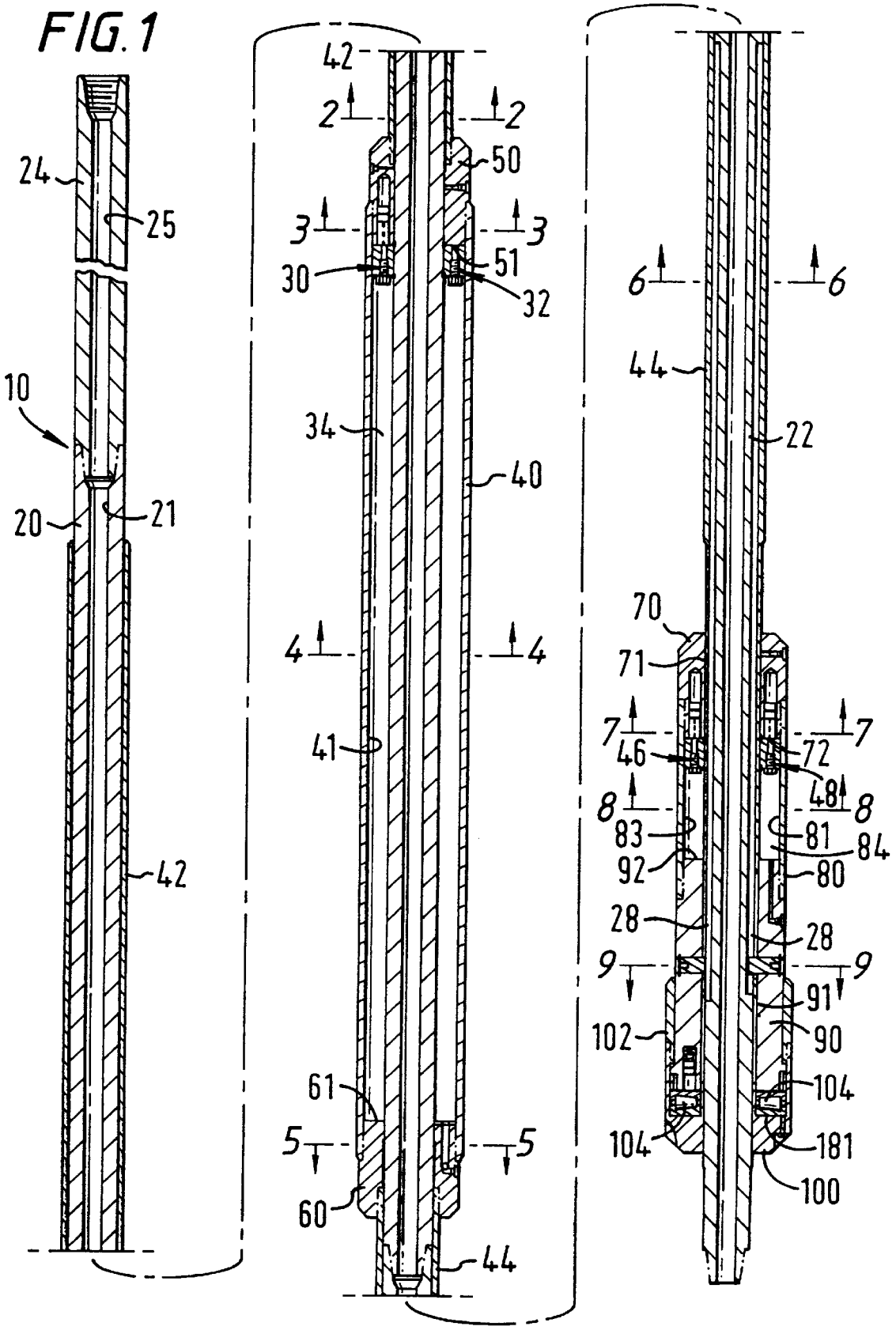
FIG. 1 is a side cross-section view of a system according to the present invention

FIG. 1 shows a tool 10 according to the present invention that may be used in a tubular string to control the rate of advance or descent of the string and thus control the rate of advance or descent of another tool, device, or apparatus connected to or in the string. For example, and without limitation, the tool 10 may be used in a tubular string of tubing, casing, or pipe; it may be used with a mill or mills, with a drill bit, or with a mill-drill tool; and it may be used with a tubular string rotated by a rotary, by a downhole motor or both.

Figure 1A:
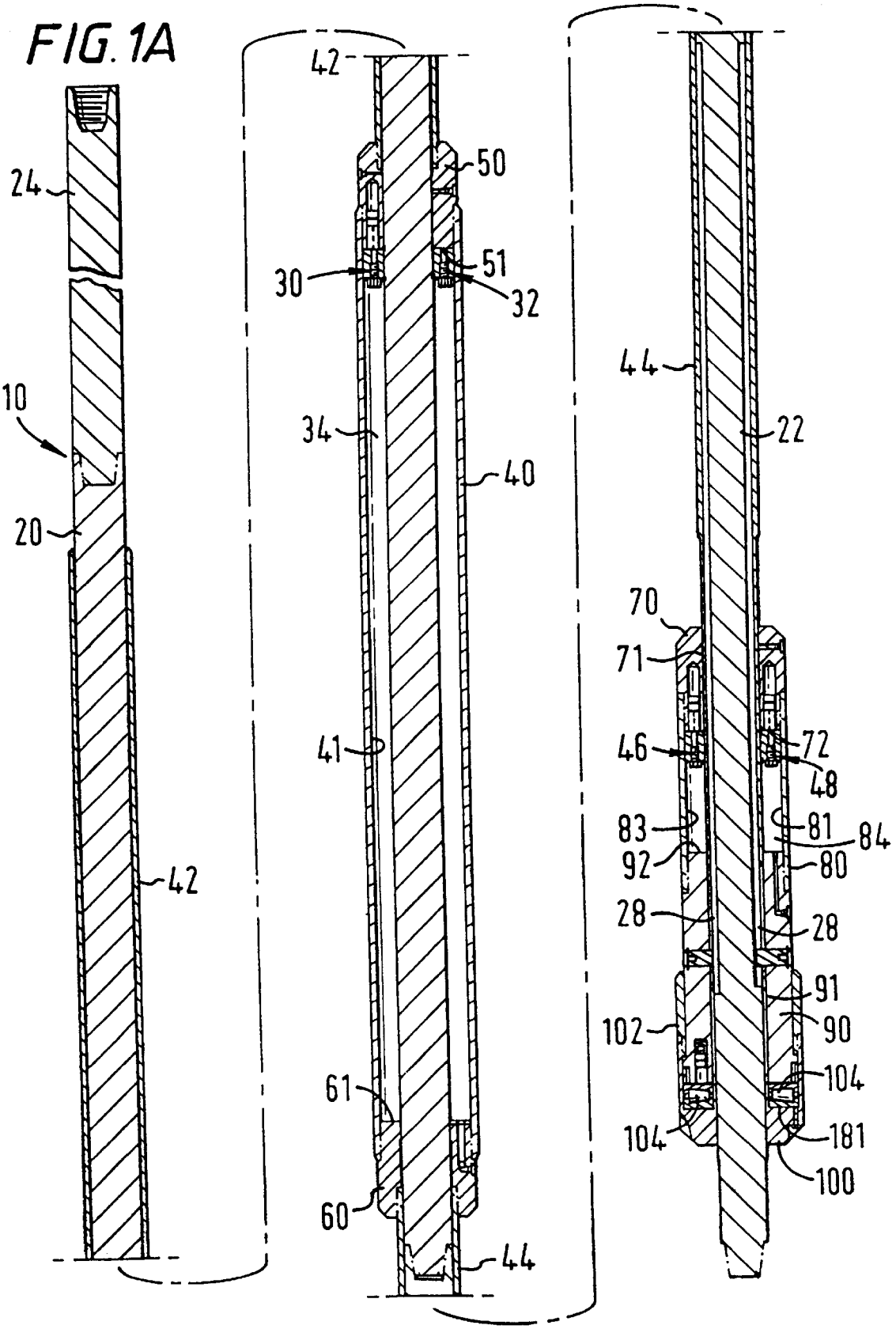
FIG. 1A is a side-cross section view of an alternative embodiment of the system of FIG. 1.
Figure 2:
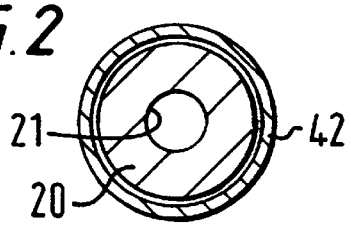
FIG. 2 is a cross-section view along line 2—2 of FIG. 1.
Figure 3:
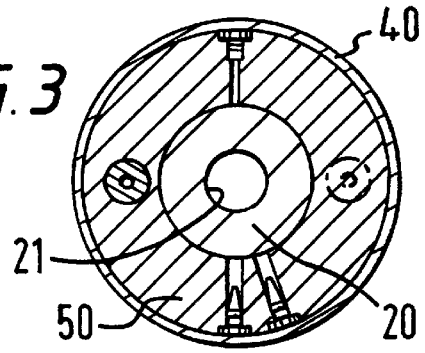
FIG. 3 is a cross-section view along line 3—3 of FIG. 1.
Figure 4:
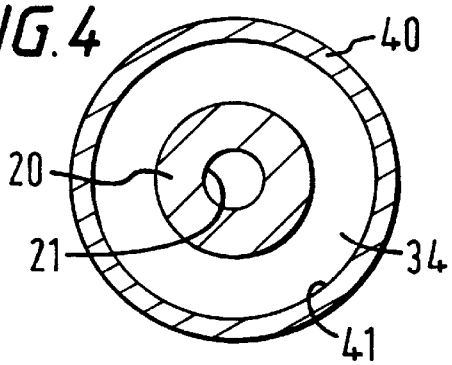
FIG. 4 is a cross-section view along line 4—4 of FIG. 1.
Figure 5:
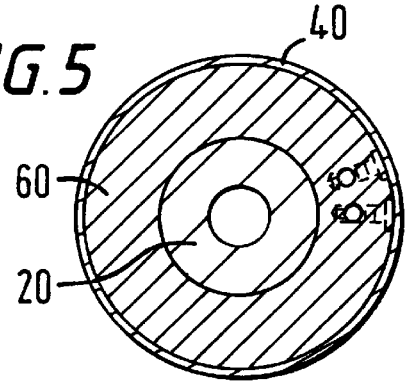
FIG. 5 is a cross-section view along line 5—5 of FIG. 1.
Figure 6:
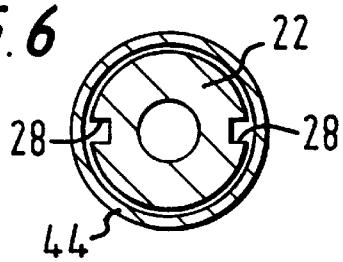
FIG. 6 is a cross-section view along line 6—6 of FIG. 1.
Figure 7:
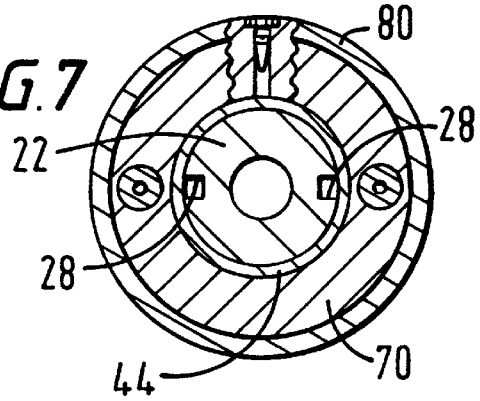
FIG. 7 is a cross-section view along line 7—7 of FIG. 1.
Figure 8:
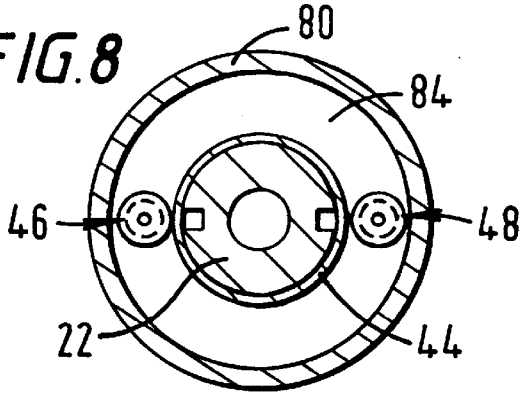
FIG. 8 is a cross-section view along line 8—8 of FIG. 1.
Figure 9:
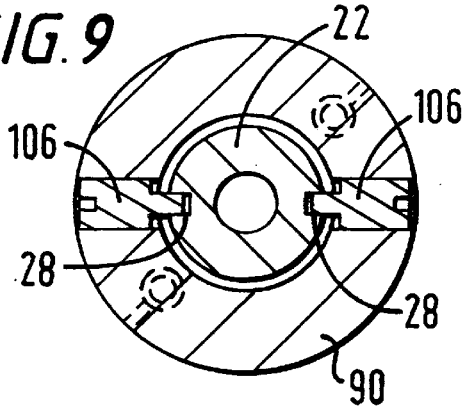
FIG. 9 is a cross-section view along line 9—9 of FIG. 1.

In one aspect the tool 10 includes an upper mandrel extension 24, an upper mandrel 20, threadedly connected to the upper mandrel extension 24, and a lower mandrel 22 threadedly connected to the upper mandrel 20. In the embodiment of the tool 10 shown, fluid flows through the tool 10 from top to bottom through a flow bore 25 through the mandrel extension 24, a flow bore 21 through the upper mandrel 20, and through a flow bore 23 through the lower mandrel 22. However one or more or all of the mandrel extension 24, upper mandrel 20 and lower mandrel 22 may be solid (e.g. as shown in FIG. 1A) or they may be replaced by a single solid member. The tool 10 may be used within a tubular or tubulars or it may be used at a point in a tubular string outside of tubulars such as well casing; e.g. but not limited to, in a tubular string above a well-head on a sea floor or in a tubular string in a derrick.

The rate of descent or advance of the mandrel system (upper mandrel extension 24, upper mandrel 20, lower mandrel 22) is controlled by one or more flow control assemblies secured to the mandrel system and movable in fluid in one or more enclosed volumes of fluid formed around a portion of the mandrel system. Each flow control assembly has a part movable through an enclosed volume. The part is movable when fluid in the enclosed volume flows through an orifice, valve, opening, or flow control device in the flow control assembly. The orifice, opening, valve, or flow control device is sized so that the fluid moves at a certain rate through the flow control assembly and, thereby, the flow control assembly moves at a desired rate down through the enclosed volume. In turn the mandrel system, and hence the tubular string containing it, move down (or forward) at the controlled rate of movement of the flow control assemblies that are secured to the mandrel system. It is within the scope of this invention to use one flow control assembly in one enclosed volume; to use a plurality of flow control assemblies in a plurality of enclosed volumes; to use flow control assemblies with a first rate of movement in a first enclosed volume and additional flow control assemblies with different rates of movement in additional enclosed volumes; or to use one or more flow control assemblies in enclosed volume(s) to control the rate of movement of members defining another enclosed volume. The enclosed volumes contains liquid, e.g. hydraulic fluid, oil, ethylene glycol, water or any suitable clean liquid. In other aspects it contains a gas, e.g. air, nitrogen, or helium, or a mixture thereof.

The tool 10 as shown in FIG. 1 has two upper flow control assemblies 30 and 32 movably disposed in an enclosed volume 34 of fluid, e.g. but not limited to hydraulic fluid or oil. The enclosed volume 34 is defined generally by an interior surface 41 of a sleeve 40, a lower end 51 of an upper cap 50, and an upper end 61 of a lower cap 60. An upper sleeve 42 is secured to the upper cap 50 and the mandrel system is movable within the upper sleeve 42.

A top end of a middle sleeve 44 is secured to the lower cap 60 and a bottom end of the middle sleeve 44 is movably disposed in and through a bore 71 through a cylinder cap 70, a bore 81 of a lower housing 80, and a bore 91 of a body 90.

Flow control assemblies 46 and 48 are secured to the lower end of the middle sleeve 44 and are movable in an enclosed volume 84 of fluid, e.g. but not limited to hydraulic fluid or oil. The enclosed volume 84 is defined generally by a lower end 72 of the cylinder cap 70, an inner surface 83 of the lower housing 80 and an upper end 92 of the body 90.

When the flow control assemblies 46, 48 move in the enclosed volume 84, the middle sleeve 44, lower cap 60, sleeve 40, upper cap 50 and upper sleeve 42 move together.

A retainer sleeve 102 is secured to a bearing housing 100 and a lower portion of the body 90 is disposed within the retainer sleeve 102. A plurality of roller bearings 104 are rotatably mounted in a chamber 181 (in the bearing housing 100 so that both enclosed volumes 34 and 84 and the members defining them along with the sleeves 40, 42, and 44 are rotatable on the roller bearings 104 and are, therefore, rotatable with the mandrel system. One or more keys 106 extending through the body 90 extend into keyways 28 of the lower mandrel 22 so that as the mandrel 22 rotates the body 90 and items attached thereto rotate, including the lower sleeve 44). The retainer sleeve 102 (and items connected thereto) does not rotate.

Figure 10:
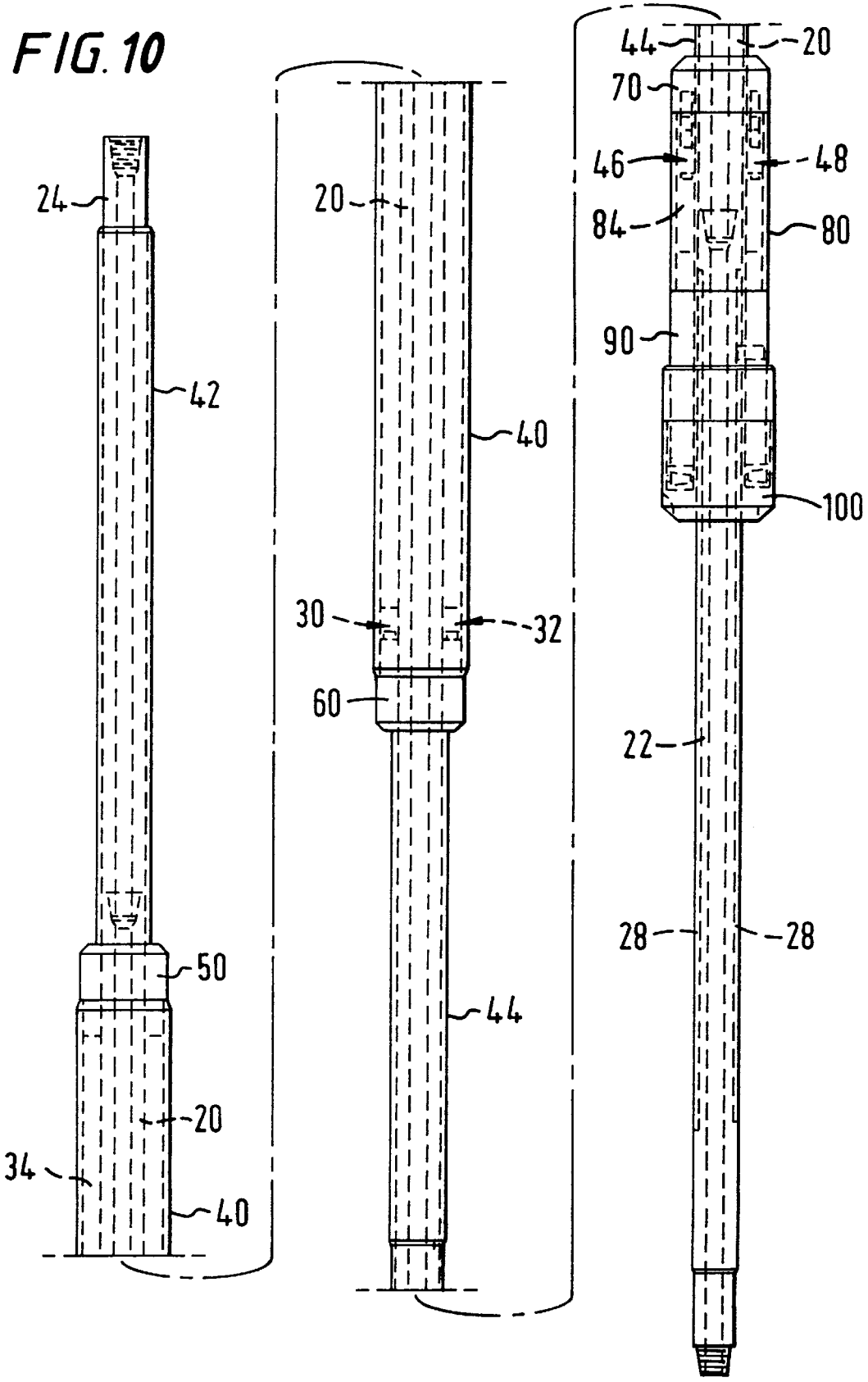
FIG. 10 is a side cross-section view of a system according to the present invention.

As shown in FIG. 10 the mandrel system has moved down to the extent of the enclosed volume 34 and the flow control assemblies 30, 32 have moved down from the top of the enclosed volume 34 to the bottom thereof.

Figure 12:
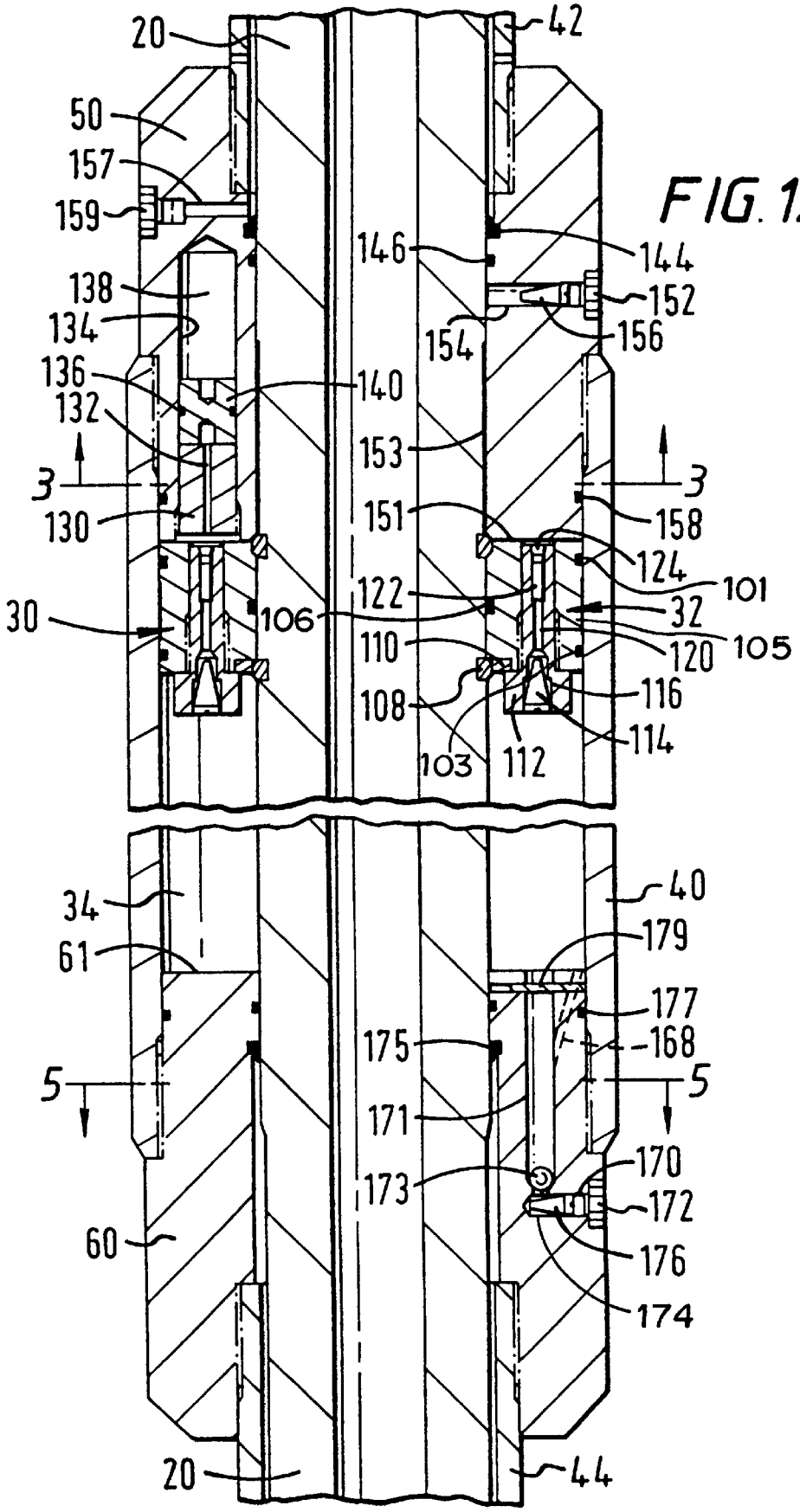
FIG. 12 shows an enlarged view of part of the system of FIG. 1.

FIG. 12 shows an enlargement of the upper cap 50 and the lower cap 60. The flow control assembly 32 includes a piston 105 whose interface with the sleeve interior surface 41 is sealed with o-rings 101, 103 and whose interface with the exterior of the mandrel 20 is sealed with o-ring 106. Split locking rings 108 secure the flow control assembly 32 to the upper mandrel 20. A retainer ring 110 retains the top split locking ring 108 in place. A screen 114 for screening particles in the fluid and thereby preventing clogging of the flow control assembly is disposed in a bore 116 of a housing 112 in the piston 100. A controlled-size orifice device 120 is disposed in the bore 116 between the screen 114 and a relief valve assembly 122. A screen 124 is disposed above (to the left in FIG. 12) the relief valve assembly 122.

In one aspect the controlled-size orifice device 120 is a commercially available Flosert device sold by the Lee Company with an orifice sized to permit a flow therethrough of about 0.1 gallons per minute. One, two, three, four or more Floserts may be used. In one aspect the relief valve assembly includes two relief valves, one set at 200 p.s.i. and one set at 400 p.s.i. (to relieve fluid pressure inside the enclosed volume and control the rate of advance of the system). The flow control assembly 30 is like the flow control assembly 32.

In the event pressure external to the sleeve 40 pushes the sleeve in decreasing the volume of the enclosed volume 34, fluid from the compressed volume may flow through a bore 132 of a piston retainer 130 to contact and move a piston 140 movably disposed in a channel 134. On the other side of the piston 140 (to the left in FIG. 12) is an amount of a compressible fluid 138, (e.g., but not limited to gas, air, nitrogen, helium). A seal 136 seals the piston/upper cap interface. To the extent the enclosed volume 34 is decreased, the piston 140 moves, compressing the fluid 138. Fluid from the enclosed volume 34 may flow to the bore 132 directly from the enclosed volume 34 or through the flow control assemblies. A wiper 144 is secured to the upper cap 50 to wipe the mandrel's surface and to inhibit the passage of contaminants to the seal 146. An o-ring 146 seals the mandrel/upper cap interface. A plug 152 is removably disposed in a fill hole 154 through which fluid may be pumped to fill the enclosed volume 34. A screen 156 to filter incoming fluid is also disposed in the hole 154. A seal 158 seals the upper cap/sleeve interface. A plug 159 is removably emplaced in a wash port 157. The wash port 157 provides access to the enclosed volume, e.g. at the earth's surface to introduce fluid thereinto to reset the tool. Fluid flows through the fill hole 154, to and through a channel 153, and either into the enclosed volume 34 through a channel 151 and the flow control assembly or directly into the enclosed volume 34.

The lower cap 60 has a plug 172 removably emplaced in a channel 170 for filling fluid into the enclosed volume 34. A filtering screen 176 is placed in the channel 174. To prevent fluid from escaping from the enclosed volume 34 a ball 173 is movably disposed in a channel 171 which is in fluid communication with the channel 174 and with the enclosed volume 34. When the ball 173 is seated as shown in FIG. 12, fluid may not flow to the channel 174. A pin 179 holds the ball in the channel 171. An o-ring seal 177 seals the lower cap/sleeve interface. A wiper ring 175 is secured to the lower cap 60. A vent channel 168 is disposed so that during filling through the channel 174, (the ball 173 is moved against the pin 179 and fluid flows into the enclosed volume 34) air or gas is vented and not trapped in the enclosed volume.

Figure 13:
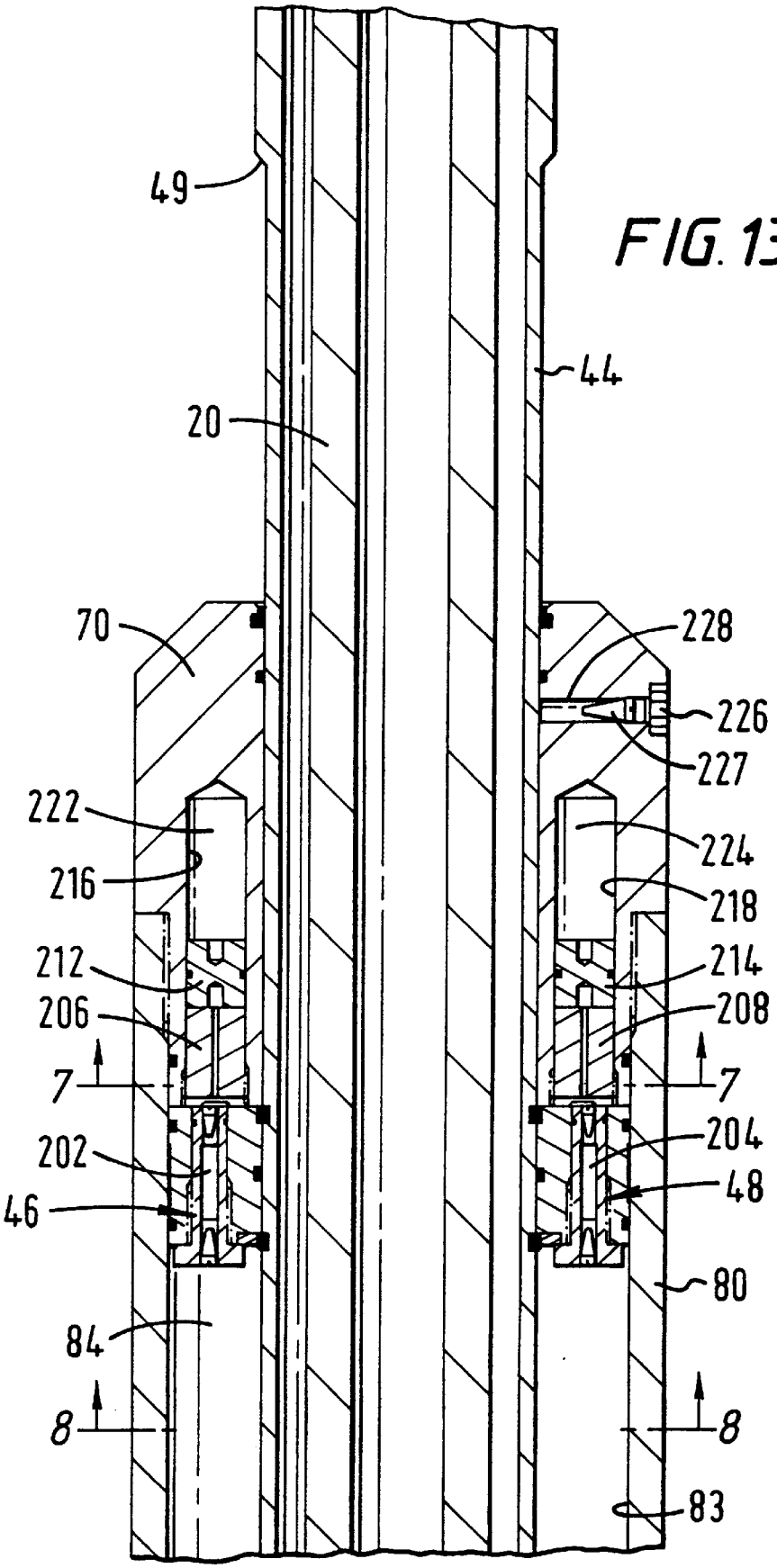
FIG. 13 shows an enlarged view of part of the system of FIG. 1.

As shown in detail in FIG. 13, the flow control assemblies 46, 48 are like the flow control assemblies 30, 32 described above and function in a similar fashion. However, in this embodiment, the flow control assemblies 46, 48 have no relief valves (flow is possible in either direction) and controlled-orifice fluid flow devices 202, 204 permit fluid flow at a significantly different rate than that of the assemblies 30, 32. In one aspect the controlled-orifice fluid flow device 202, 204 permit fluid to flow at a desired rate so that the sleeve 44 and connected items move down to the full extent of permitted movement in about 55 seconds.

Compression compensation devices 206, 208 are structured like and function as the piston 140 and piston retainer 130 (see FIG. 12 and descriptive text above). Pistons 212, 214 move in chambers 216, 218 respectively which contain amounts 222, 224 of compressible fluid. A removable plug 226 selectively closes off a fill channel 228 through which fluid may be introduced into the enclosed volume 84. A filtering screen 227 is disposed in the fill channel 228.

A shoulder 49 on the lower sleeve 44 permits the sleeve 44, the lower cap 60, and everything connected to or interconnected with the lower cap 60 to move down to the extent that the lower sleeve 44 moves within the body 90 and the cylinder cap 70. Space is provided between the exterior of the lower mandrel 22 and the inner surface of the body 90 in which the lower sleeve 44 may move downwardly.

The flow control assemblies 48, 48 are secured to the lower sleeve 44 (as the flow control assemblies 30, 32 are secured to the upper mandrel 20). Keyways in the sleeve 44 accommodate the pins 106.

As shown in FIG. 13, each pin 106 projects through the body 90, and into a keyway 28 of the lower mandrel 22, thus connecting the body 90 for rotation with the lower mandrel 22. A plug 95 is removably emplaced in a channel 96 which is in fluid communication with a channel 97 for filling (or evacuating) the enclosed volume 84. A filtering screen 99 is emplaced in the channel 96. A vent channel 98 prevents air entrapment.

Figure 14:
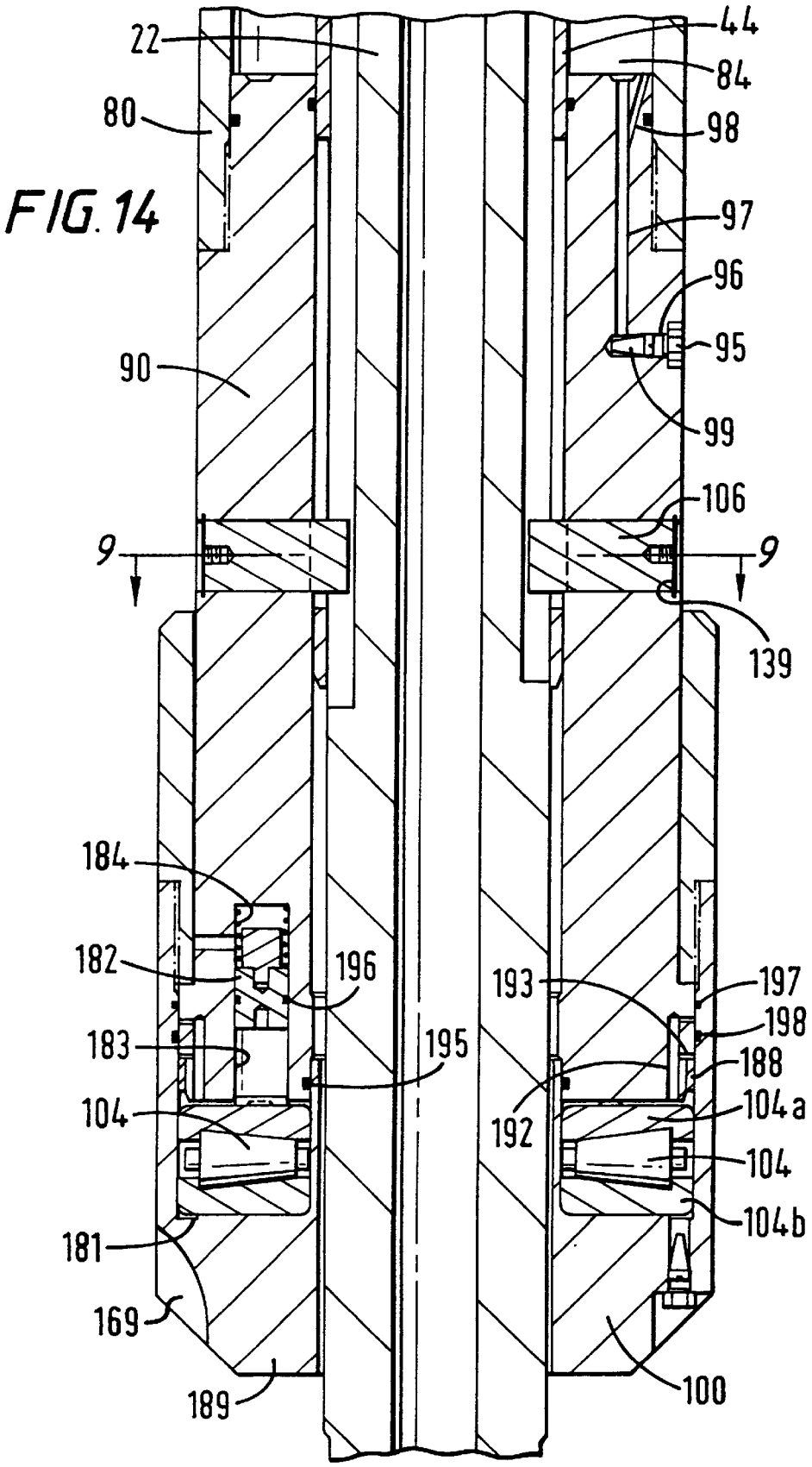
FIG. 14 shows an enlarged view of part of the system of FIG. 1.

The roller bearings 104 are disposed in a chamber 181 which is filled with bearing lubricant. A piston 182 movably disposed in a channel 183 is biased downwardly (to the right in FIG. 14) by a spring 184. The chamber 181 communicates with the channel 183 so that heated lubricant that expands (e.g. heated due to the rotation of the roller bearings 104) can move into the channel 183, pushing the piston 182 upwardly against the spring 184. An upper race **104*a* and a lower race 104*b* encompass the roller bearings 104. A side bearing 188 provides a side bearing for the end of the body 90 which is lubricated via channels 192 and 193. One or more pistons 182 may be used. An o-ring 195 seals the bearing housing/body interface. An o-ring 196 seals the piston/body interface. An o-ring 197 seals the body/bearing housing interface. An o-ring 198 seals an interface between a lower body 189 (in which the chamber 181 is located) and the body 90. Notches 169 permit fluid flow around the lower body 189 when it is seated on a wellhead. A retainer ring 139 holds the pins 106** in place.

FIG. 10 shows the position of the mandrel system following the descent and/or advance of the flow control assemblies 30, 32 in the enclosed volume 34.

Figure 11:
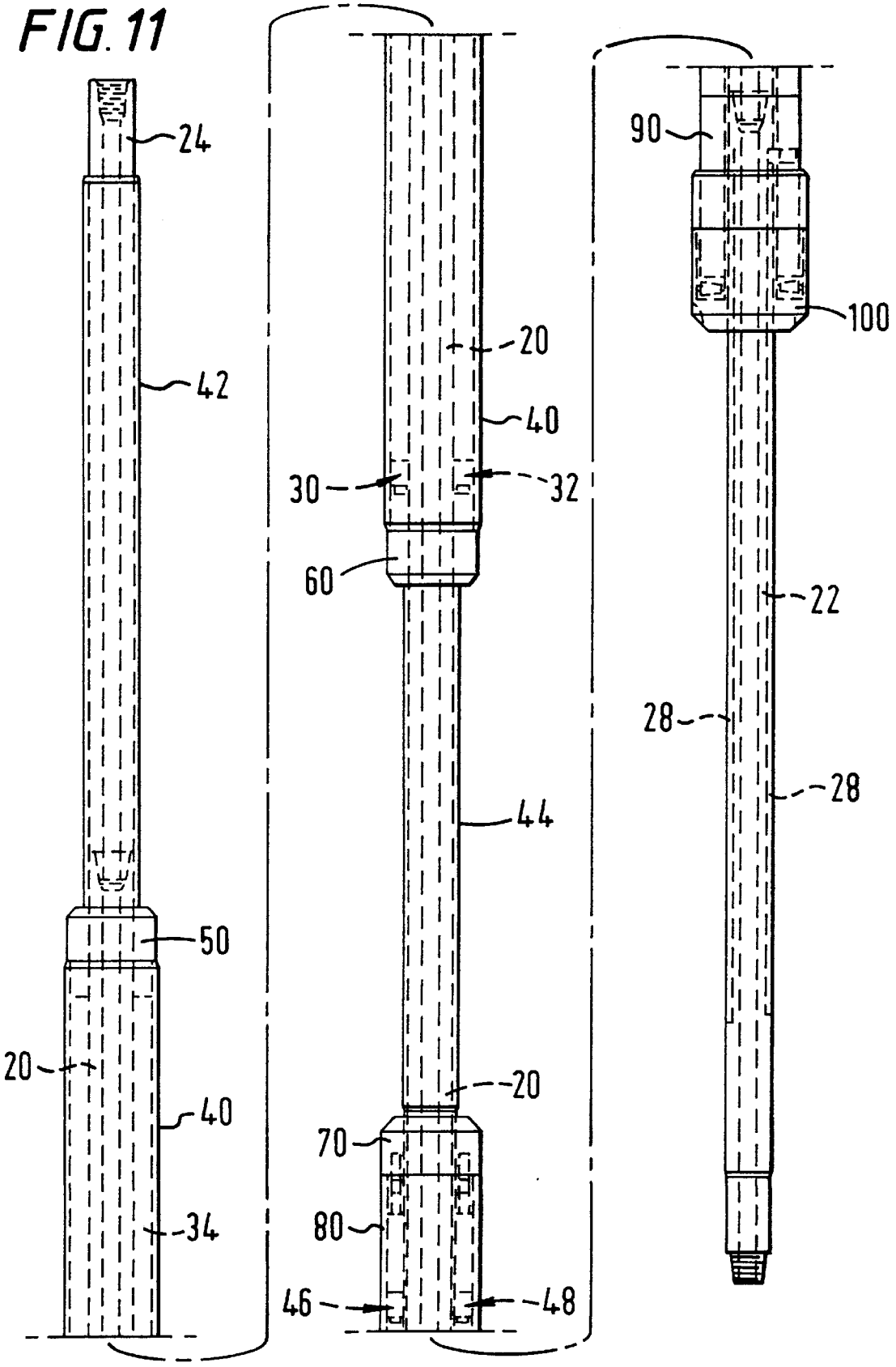
FIG. 11 is a side cross-section view of a system according to the present invention.

FIG. 11 shows the position of the mandrel system following the descent of the flow control assemblies 46, 48 in the enclosed volume 84.

Figure 15A:
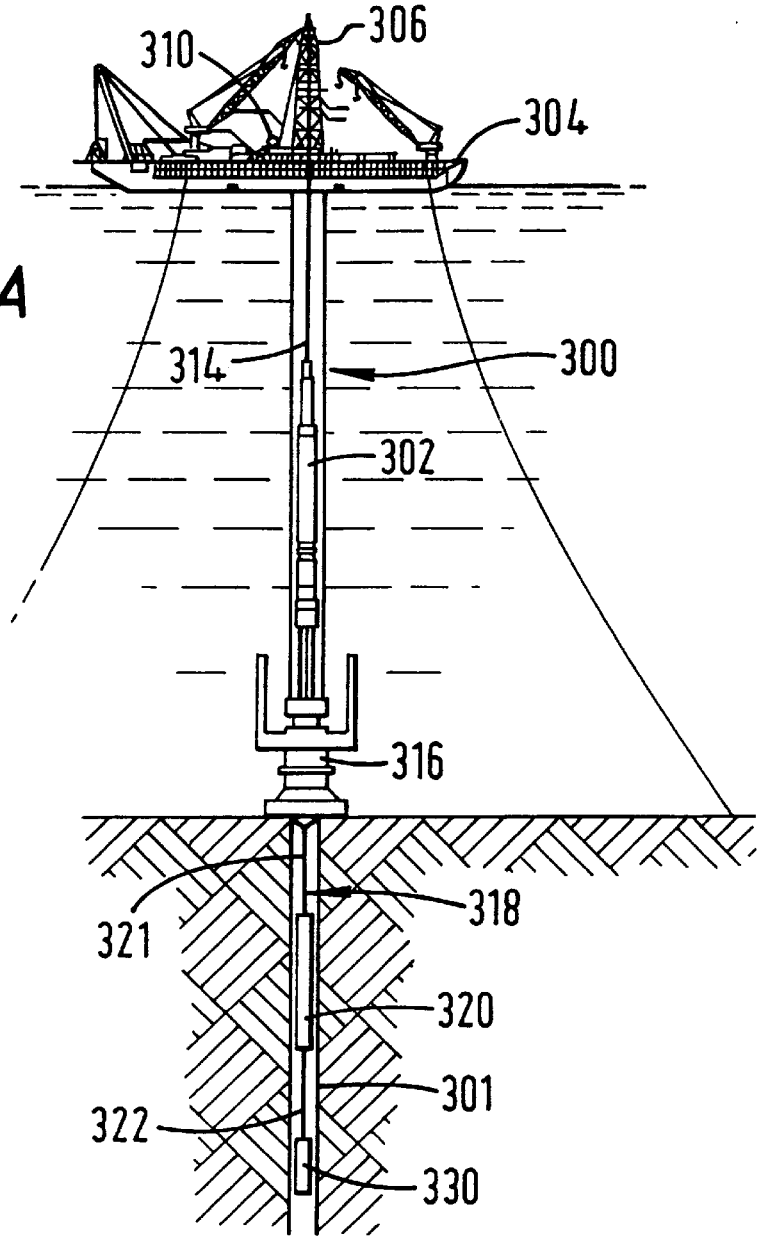
FIG. 15A is a schematic view of a system according to the present invention and FIG. 15B shows part of the system.
Figure 15B:
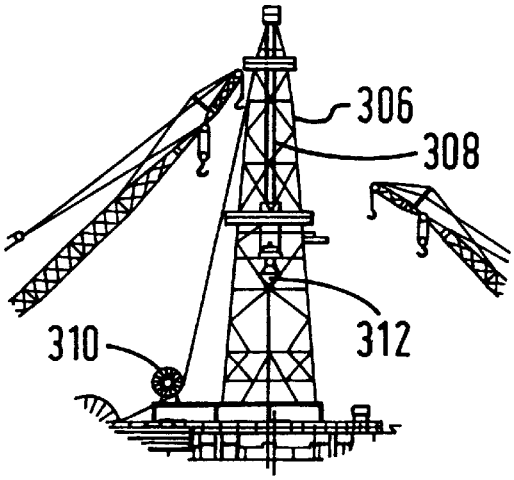

FIGS. 15A and 15B illustrate one particular embodiment of a milling system 300 employing a tool 302 (like the tool 10, FIGS. 1–14, described above). The tool 302 is part of a tubular string 314 extending down from a derrick 306 on a ship 304 into a wellbore 301. Support cables 308 support a swivel 312 which supports the string 314 and a typical drum and brake apparatus 310 controls raising and lowering of the cables and swivel. The string extends beneath the tool 302 as the string 318 which includes drill pipe 321, 322 and drill collars 320. A milling system 330 is connected to the drill pipe 322.

A bearing housing (like the bearing housing 100) has a lower end that rests on and against a corresponding cup or part (e.g. an upper end of a casing hanger) of a wellhead casing (in one aspect with a chamber to water a bevelled end of the housing) of the wellhead 316. Notches in the lower end (like the notches 169 of the bearing housing 100, FIG. 14) permit fluid flow between the bearing housing and the cup so that circulating fluid may flow up in the annulus between the tool and the casing that extends up to the sea floor and up to the ship 304.

In a typical operation of the system 300, the string 314, 318 with the milling system 330 is lowered into a main cased wellbore to contact a tubular to be milled, e.g. but not limited to, a liner of a lateral wellbore extending from the main wellbore; and milling produces a window or hole through the liner back into the main wellbore. The tool 302 is lowered so that it is seated in the cup and the mill system 330 has contacted the liner (not shown). The flow control assemblies (corresponding to the flow control assemblies 30, 32, FIG. 1) permit a mill (or mills) of the mill system 330 to advance at a rate of about ¼ inch to ½ inch per minute, providing a controlled, relatively slow advance of the mill (s). This inhibits slipping of the mill on top of the liner—which can occur when the mill(s) advance too quickly—and also facilitates use of the mill system 330 with a milling guide as disclosed in pending U.S. application Ser. No. 08/590,747 filed on Jan. 24, 1996, which is incorporated fully herein for all purposes and is co-owned with the present invention.

Typically a ship 304 and known compensators and compensation systems make it possible for the ship to move up and down with waves and sea swells while the swivel and, therefore, the string stay at substantially the same level. However, extreme waves and sea swells cannot be handled by various known compensators and, when using a milling system like the system 300 with a tool 302 (or tools 10), a mill is pulled up off of the liner being milled and (in systems without a tool according to the present invention) the mill is pushed, slammed, or impacted back down into the liner. But, with the tool 302, upon raising of the mill in response to a wave or swell, the shoulder at the bottom of the bearing housing moves away from the cup of the wellhead 316. When this occurs, the flow control assemblies that control mill advance move up in their enclosed volume (e.g. the flow control assemblies 30, 32 in the enclosed volume 34; e.g. half-way up in this enclosed volume). Due to the check valves in the flow control assemblies, the flow control assemblies are prevented from moving back up to the top of the enclosed volume. As soon as the swell is past and weight is again on the milling system, the milling system (which has been continuously rotating) begins to progress downwardly again due to the subsequent downward progression of the flow control assemblies in the enclosed volume. Because of the distance of the lower flow control assemblies (e.g. the flow control assemblies 46, 48, FIG. 1) above the top end of the body (e.g. the body 90) the mill still does not instantly move back into contact with the liner. Not until the flow control assemblies move down to contact the body (see FIG. 11) does the mill move to re-contact the liner. For this reason in certain embodiments the lower flow control assemblies have flow orifices sized so that they move relatively quickly, e.g. in a minute, so that milling can quickly proceed following a swell.

In addition to providing timed controlled advance or movement of a wellbore tool or appratus (or instead thereof), systems according to the present invention are used to advance or move a device or tool a known distance, either the entire distance of the stroke length of the system or an increment of that distance. In one aspect, the system is partially stroked at the surface, i.e., the flow control assemblies are allowed to move some known portion of the total stroke length of the tool so that whatever known portion remains may be stroked once the system is in the hole. In one aspect, the system is used with a mill and the mill's advance is stopped when the end of the system's stroke is reached.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A wellbore motion control apparatus for controlling the motion of a tubular wellbore string in a wellbore extending from a surface down into the earth, the motion control apparatus comprising a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus securable to a member of the tubular wellbore string while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing controlling movement of the member of the tubular wellbore string and thereby controlling movement of the tubular string in the wellbore.

2. The wellbore motion control apparatus of claim 1 wherein the member of the tubular string is a mandrel with a top end and a bottom end, each end connectible to another member of the tubular string.

3. The wellbore motion control apparatus of claim 2 wherein the mandrel has a fluid flow bore therethrough from the top end thereof to the bottom end thereof.

4. The wellbore motion control apparatus of claim 2 wherein the at least one fluid passage apparatus is secured to the mandrel.

5. The wellbore motion control apparatus of claim 2 further comprising the housing having a selectively openable top port and a selectively openable bottom port for accessing the hollow interior of the housing to remove therefrom and to introduce thereinto fluid.

6. The wellbore motion control apparatus of claim 2 wherein the mandrel is solid.

7. The wellbore motion control apparatus of claim 1 wherein the bottom end of the housing has a bevelled edge for seating against a corresponding edge of a part of a wellhead.

8. The wellbore motion control apparatus of claim 1 wherein the at least one fluid passage apparatus is at least two fluid passage apparatuses.

9. The wellbore motion control apparatus of claim 1 wherein the fluid in the housing is liquid.

10. The wellbore motion control apparatus of claim 1 wherein the fluid in the housing is gas.

11. The wellbore motion control apparatus of claim 1 wherein the fluid flow channel is sized so that the fluid passage apparatus traverses the housing from one end thereof to the other end thereof in about an hour.

12. The wellbore motion control apparatus of claim 1 wherein the fluid flow channel is sized so that the fluid passage apparatus traverses the housing from one end thereof to the other end thereof in about a minute.

13. The wellbore motion control apparatus of claim 1 wherein the tubular wellbore string has a lower end and cutting apparatus attached at the lower end.

14. The wellbore motion control apparatus of claim 13 further comprising the cutting apparatus.

15. The wellbore motion control apparatus of claim 13 wherein the cutting apparatus comprises tubular milling apparatus.

16. The wellbore motion control apparatus of claim 13 wherein the cutting apparatus comprises drilling apparatus.

17. The wellbore motion control apparatus of claim 13 wherein the cutting apparatus comprises mill-drill apparatus.

18. The wellbore motion control apparatus of claim 1 further comprising check valve apparatus in the fluid flow channel of the at least one fluid passage apparatus for permitting flow through the fluid flow channel from the bottom of the at least one fluid passage apparatus to the top thereof and out therefrom into space above the at least one fluid passage apparatus in the hollow interior of the housing, the check valve apparatus preventing fluid flow in the opposite direction from the space above the at least one fluid passage apparatus to a space below it in the hollow interior of the housing.

19. The wellbore motion control apparatus of claim 1 further comprising a bearing apparatus secured to the member of the tubular wellbore string, and the wellbore motion control apparatus having a bottom end resting on and rotatable on the bearing apparatus.

20. The wellbore motion control apparatus of claim 19 further comprising the bearing apparatus having a plurality of rollers rotatably mounted in a primary chamber therein, the primary chamber containing lubricant for lubricating the rollers, an expansion chamber in fluid communication with the primary chamber, and a piston movably disposed in the expansion chamber and biased downwardly by a spring in the expansion chamber above the piston, the piston movable upwardly in response to lubricant expanded by heating from the primary chamber.

21. The wellbore motion control apparatus of claim 20 further comprising an amount of compressible gas above the piston in the expansion chamber which gas is compressed as the piston moves up.

22. The wellbore motion control apparatus of claim 1 further comprising a housing chamber having a top and a bottom, and the housing's hollow interior in fluid communication with the housing chamber, a piston movably disposed in the housing chamber with an amount of gas above the piston in the housing chamber, the piston positioned for contact by the fluid in the housing's hollow interior so that compression of the housing by pressure of fluid external thereto moves the fluid in the hollow interior against the piston forcing it upwardly in the housing chamber and compressing the gas above the piston.

23. A wellbore motion control apparatus for controlling the motion of a tubular wellbore string in a wellbore extending from a surface down into the earth, the motion control apparatus comprising a first housing with a top end, a bottom end, and a hollow interior having an interior volume with fluid therein, at least one first fluid passage apparatus having a top end and a bottom end and disposable in the hollow interior of the first housing, the at least one first fluid passage apparatus having a first fluid flow channel extending therethrough from the top end to the bottom end, and the at least one first fluid passage apparatus securable to a member of the tubular wellbore string while the at least one first fluid passage apparatus is positioned within the hollow interior of the first housing so that fluid in the hollow interior of the first housing is flowable through the first fluid flow channel at a first flow rate from one end of the first fluid passage apparatus to the other end of the first fluid passage apparatus permitting movement of the first fluid passage apparatus within the first housing controlling movement of the member of the tubular wellbore string and thereby controlling movement of the tubular string in the wellbore, a second housing with a top end, a bottom end, and a hollow interior having an interior volume with fluid therein, at least one second fluid passage apparatus having a top end and a bottom end and disposable in the hollow interior of the second housing, the second fluid passage apparatus having a second fluid flow channel extending therethrough from the top end to the bottom end, and the at least one second fluid passage apparatus securable to the member of the tubular wellbore string while the at least one second fluid passage apparatus is positioned within the hollow interior of the second housing so that fluid in the hollow interior of the second housing is flowable through the second fluid flow channel at a second flow rate from one end of the second fluid passage apparatus to the other end of the second fluid passage apparatus permitting movement of the second fluid passage apparatus within the second housing controlling movement of the member of the tubular wellbore string and thereby controlling movement of the tubular string in the wellbore.

24. The wellbore motion control apparatus of claim 23 wherein the first flow rate is less than the second flow rate.

25. The wellbore motion control apparatus of claim 23 wherein the first flow rate is such that the at least one first fluid passage apparatus traverses the first housing from one end to the other end thereof in about an hour and wherein the second flow rate is such that the at least one second fluid passage apparatus traverses the second housing from one end thereof to the other in about a minute.

26. The wellbore motion control apparatus of claim 23 wherein check valve apparatus in the first fluid flow channel of the at least one first fluid passage apparatus for permitting flow through the first fluid flow channel from the bottom of the at least one first fluid passage apparatus to the top thereof and out therefrom into space above the at least one first fluid passage apparatus in the hollow interior of the first housing, the check valve apparatus preventing fluid flow in the opposite direction from the space above the at least one first fluid passage apparatus to a space below it in the hollow interior of the first housing.

27. A wellbore motion control apparatus for controlling the motion of a tubular wellbore string in a wellbore extending from a surface down into the earth, the motion control apparatus comprising a housing with a top end, a bottom end, and a hollow interior having an interior volume with fluid therein, a mandrel having a top end and a bottom end, the mandrel mounted for movement in the housing, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the mandrel while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing thereby controlling movement of the mandrel.

28. A method for controlling the motion of a tubular string used in wellbore operations, the method comprising connecting a wellbore motion control apparatus in the tubular string, the wellbore motion control apparatus comprising a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus securable to a member of the tubular wellbore string while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing controlling movement of the member of the tubular wellbore string and thereby controlling movement of the tubular string in the wellbore, and flowing the fluid in the hollow interior of the housing from a space below the at least one fluid passage apparatus, through the at least one fluid passage apparatus, to a space above the at least one fluid passage apparatus as the at least one fluid passage apparatus moves down in the housing thereby controllably moving the tubular string down.

29. A method for controlling the motion of an item used in wellbore operations, the method comprising connecting a wellbore motion control apparatus between the item and a rig support for the item, the wellbore motion control apparatus comprising a housing with a top end, a bottom end, and a hollow interior having an interior volume with fluid therein, a mandrel having a top end and a bottom end, the mandrel mounted for movement in the housing, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the mandrel while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing thereby controlling movement of the mandrel, and flowing the fluid in the hollow interior of the housing from a space below the at least one fluid passage apparatus, through the at least one fluid passage apparatus, to a space above the at least one fluid passage apparatus as the at least one fluid passage apparatus moves down in the housing thereby controllably moving the item down.

30. The method of claim 29 wherein control apparatus for opening and closing the fluid flow channel controls flow through the at least one fluid passage, the method further comprising controlling flow through the fluid flow channel.

* * * * *